US011542640B2

(12) United States Patent
Tamura et al.

(10) Patent No.: US 11,542,640 B2
(45) Date of Patent: Jan. 3, 2023

(54) WEFT INSERTION METHOD AND DEVICE IN WATER JET LOOM

(71) Applicant: TSUDAKOMA KOGYO KABUSHIKI KAISHA, Ishikawa-ken (JP)

(72) Inventors: Koichi Tamura, Ishikawa-ken (JP); Keiichi Myogi, Ishikawa-ken (JP)

(73) Assignee: TSUDAKOMA KOGYO KABUSHIKI KAISHA, Ishikawa-ken (JP)

( * ) Notice: Subject to any disclaimer, the term of this patent is extended or adjusted under 35 U.S.C. 154(b) by 176 days.

(21) Appl. No.: 16/862,868

(22) Filed: Apr. 30, 2020

(65) Prior Publication Data

US 2020/0354865 A1 Nov. 12, 2020

(30) Foreign Application Priority Data

May 6, 2019 (JP) ..... JP2019-087219

(51) Int. Cl.
*D03D 47/36* (2006.01)
*D03D 47/34* (2006.01)
(Continued)

(52) U.S. Cl.
CPC ..... *D03D 47/362* (2013.01); *D03D 47/34* (2013.01); *D03D 49/50* (2013.01); *D03J 1/04* (2013.01); *D03J 2700/06* (2013.01)

(58) Field of Classification Search
None
See application file for complete search history.

(56) References Cited

U.S. PATENT DOCUMENTS 4,590,972 A * 5/1986 Sugita ..... D03D 47/3053 139/435.2
4,716,941 A * 1/1988 Takegawa ..... D03D 47/363 139/336
(Continued)

FOREIGN PATENT DOCUMENTS

JP 2005-002506 A 1/2005
JP 2005002506 A * 1/2005
(Continued)

OTHER PUBLICATIONS

Oct. 1, 2020, European Search Report issued for related EP Application No. 20172412.7.

*Primary Examiner* — Khoa D Huynh
*Assistant Examiner* — Grace Huang
(74) *Attorney, Agent, or Firm* — Paratus Law Group, PLLC

(57) ABSTRACT

A weft detection sensor is provided that detects a passage of a weft to determine a passage timing of a weft circulating around a storage drum, and a weft insertion method includes setting in advance a reference value of a set position arrival timing in association with a set arrival position, regarding the set arrival position and the set position arrival timing at which a leading edge of the weft reaches the set arrival position, and determining an actual value of the set position arrival timing from the passage timing determined in weft insertion during weaving, comparing the actual value with the reference value, and in a case where a deviation occurs between the actual value and the reference value, determining a correction amount of a set value of a weft insertion related device based on the deviation so that the deviation decreases.

8 Claims, 2 Drawing Sheets

(51) Int. Cl.
*D03D 49/50* (2006.01)
*D03J 1/04* (2006.01)

(56) References Cited

U.S. PATENT DOCUMENTS 4,744,393 A * 5/1988 Takegawa ..... D03D 47/3033 139/116.2
4,784,189 A * 11/1988 Hellstrom ..... D03D 47/367 139/370.2
4,815,502 A * 3/1989 Takegawa ..... D03D 47/34 139/452
4,877,064 A * 10/1989 Pezzoli ..... D03D 47/3033 139/435.1
5,002,095 A * 3/1991 Herrin ..... D03D 39/223 139/25
5,107,902 A * 4/1992 Wahhoud ..... D03D 47/3033 139/435.1
5,154,209 A * 10/1992 Takegawa ..... D03D 47/34 139/452
5,176,184 A * 1/1993 Yamada ..... D03D 47/3033 139/1 E
5,295,515 A * 3/1994 Kato ..... D03D 47/3053 139/435.1
5,440,495 A * 8/1995 Sainen ..... D03D 51/007 700/140
5,816,295 A * 10/1998 Sugita ..... D03D 47/304 139/435.2
5,937,915 A * 8/1999 Wahhoud ..... D02J 1/08 139/450
6,176,272 B1 * 1/2001 Wahhoud ..... D03D 47/363 139/435.5
6,439,271 B2 * 8/2002 Schiller ..... D03D 47/3033 139/435.2
2004/0216800 A1 * 11/2004 Siegl ..... D03D 47/304 139/435.2

FOREIGN PATENT DOCUMENTS

JP 2015-137438 A 7/2015
JP 2015137438 A * 7/2015

* cited by examiner

WEFT INSERTION METHOD AND DEVICE IN WATER JET LOOM

CROSS-REFERENCE TO RELATED APPLICATIONS

The present application claims priority from Japanese Patent Application No. 2019-087219, filed May 6, 2019, the entire content of which is incorporated herein by reference.

BACKGROUND OF THE INVENTION

Field of the Invention

The present invention relates to a water jet loom that includes a measuring and storing device including a storage device having a rotary yarn guide continuously driven to rotate and a storage drum on which a weft is wound and stored by a rotation of the rotary yarn guide, and a measuring device having a measuring roller which continuously feeds the weft from a yarn feeder toward the rotary yarn guide at a predetermined feed speed corresponding to a weft insertion length, a weft insertion related device which is involved in a weft insertion and affects a timing at which the weft starts to fly or a state where the weft flies, and is driven according to a set value stored in a set value storage, and a weft insertion device including the set value storage and a weft insertion control device for controlling drive of the weft insertion related device, in which one weft insertion is performed through a constrained flight process in which the weft flies while being constrained by a feed speed of the measuring roller by being in a state where the weft is drawn directly from the rotary yarn guide without passing through the storage drum, after a free flight process in which the weft flies in a free flight state by being drawn while the weft on the storage drum is released from the storage drum.

Background Art

As the water jet loom as described above, for example, there is a loom disclosed in JP-A-2005-002506. In the water jet loom, a measuring and storing device includes a rotary yarn guide that winds a weft around a storage drum, and a measuring roller that feeds a weft from a yarn feeder toward the rotary yarn guide. The length measuring roller is continuously driven to rotate at a rotation speed such that the weft having a length (weft insertion length) required for one weft insertion is fed in a period corresponding to one cycle of the loom (period during which a main shaft rotates once), and the rotary yarn guide is configured to be continuously driven to rotate at a rotation speed such that the weft for the weft insertion length is wound on the storage drum during the period.

In the water jet loom, a clamping mechanism is provided between the measuring and storing device and a weft insertion nozzle. Except when the weft is inserted, the weft is locked in the measuring and storing device by a locking pin of the measuring and storing device and is gripped by the clamping mechanism. Then, when the weft is inserted, first, the pressurized water discharged from a pump at a predetermined timing is supplied to the weft insertion nozzle and ejected from the weft insertion nozzle. Subsequently, the locking pin and the clamping mechanism are driven at a preset timing to release the locking by the locking pin and release the grip by the clamping mechanism. As a result, the weft insertion becomes possible, and the flying of the weft is started by the pressurized water ejected from the weft insertion nozzle as described above. First, the weft flies in a free flight state where the weft on the storage drum flies while being released from the storage drum.

In the case where the measuring and storing device is of the type described above, since the weft is fed from the measuring roller rotating at the rotation speed as described above, the length of the weft wound on the storage drum is shorter than the weft insertion length required for one weft insertion at the time when the weft starts to fly (start time of weft insertion). In the free flight process, the winding of the weft around the storage drum by the rotary yarn guide is continued, and a release speed from the storage drum accompanying the flight of the weft is faster than a winding speed. Therefore, the weft on the storage drum gradually decreases, and all the wefts are released from the storage drum before the weft insertion is ended.

As a result, thereafter, the weft is drawn directly from the rotary yarn guide rotating around the storage drum, that is, a constrained flight state is such that the weft flies while being constrained by a feed speed of the measuring roller. Thereafter, the locking pin is driven at a preset timing, and the weft is locked on the storage drum, thereby ending the weft insertion. After the weft insertion is ended, the clamping mechanism is driven, thereby the weft is gripped by the clamping mechanism as described above. As described above, in the water jet loom provided with the measuring and storing device of the type described above, one weft insertion is performed through the constrained flight process in which the weft flies in the constrained flight state as described above, after the free flight process in which the weft flies in the free flight state.

SUMMARY OF THE INVENTION

Additionally, in a loom in which weft insertion is performed so that the weft flies in a free flight state from the start to the end of the weft insertion, as the weaving progresses, an arrival timing (timing when a leading edge of the weft reaches a predetermined position on a receiving side) of the inserted weft often changes (becomes slower or faster). Various causes can be considered, and it is said that one of the causes is a change in the diameter of a yarn feeder that supplies the weft.

When the amount of change in the arrival timing increases, in an air jet loom in which the arrival of the weft is detected on the receiving side, the arrival of the weft is not detected within a predetermined detection period, so that the weft insertion is determined to be defective and the loom is stopped. On the other hand, in the water jet loom, since the arrival of the weft on the receiving side is not detected, as long as the leading edge of the weft reaches the receiving side, it is not determined that the weft insertion is defective. However, in the water jet loom, when the arrival timing of the weft is too late or too early, a so-called slack of weft state occurs in which the weft is woven in a slack state, which may cause a problem that the quality of the woven fabric deteriorates.

However, in the related art, in a water jet loom in which a measuring and storing device is of the type described above (hereinafter, also referred to as "water jet loom"), it was considered that the average flight speed of one weft insertion did not change significantly, and the arrival timing hardly changed. In the measuring and storing device of the type described above, this is because a measuring roller is driven in synchronism with a main shaft to feed the weft, and in the latter half of the weft insertion, the flight of the weft becomes the above-described constrained flight state. Therefore, in the related art, it is considered that the water jet loom does not cause the slack of weft due to a change in arrival timing.

In a case where the slack of weft is found in a woven fabric woven by a loom, leaving the state where such slack of weft occurs causes degradation of the quality of the woven fabric, and it is necessary to determine and eliminate the cause. The same applies to the water jet loom, and in the related art, since it was considered that the change in the arrival timing could not occur in the water jet loom as described above, the change in the arrival timing was excluded in determining the cause.

However, as a result of diligent research by the inventors of the present application, it was determined that a change in arrival timing occurs in the water jet loom, and that the degree of the change is such that the weft is slacked as described above. It is presumed that one of the cause of the change in the arrival timing is an effect due to the state of the weft (thickness and tension of the weft) in the yarn feeder being not uniform in the length direction of the weft.

Specifically, the yarn feeder for supplying the weft is formed by a plurality of yarn layers, and there may be a difference in the state of the weft between the yarn layers, particularly, between an inner yarn layer and an outer yarn layer in a radial direction. In this case, the release resistance from a storage drum or a degree of action on the weft of the conveyance force by the ejection water ejected from the weft insertion nozzle changes due to the difference in the state, thereby changing the flight state of the weft in the free flight process. As a result, the timing at which the constrained flight starts changes, which is presumed to be one of the causes of the change in the arrival timing as described above.

As described above, actually, even in the water jet loom, a change in the arrival timing that causes the slack of weft occurs. However, in the related art, as described above, it is recognized that such a change in arrival timing does not occur in the water jet loom. Therefore, in the case where the slack of weft is found in the woven fabric woven by the water jet loom, even when the cause is a change in arrival timing, in the related art, the cause could not be determined, and no solution was found to eliminate the change in the arrival timing of the weft. As a result, in the related art, weaving is continued in a state where the weft can be slacked, and the quality of the woven fabric to be woven is deteriorated.

In view of the above circumstances, in order to prevent the occurrence of quality deterioration of the woven fabric due to the change in arrival timing, an object of the present invention is to provide a weft insertion method and device for making arrival timing as constant as possible, in a water jet loom provided with a measuring and storing device of the type described above.

The present invention is based on a water jet loom provided with a weft insertion device having a measuring and storing device with a type described above, a weft insertion related device, and a weft insertion control device.

In a weft insertion method according to the present invention, the weft insertion device is provided with a weft detection sensor provided so as to face a storage drum and detecting a passage of the weft to determine a passage timing which is a passage timing of the weft circulating around the storage drum with weft insertion. Then, the weft insertion method includes setting in advance a reference value of a set position arrival timing in association with a set arrival position, regarding the set arrival position, which is an arrival position at which a leading edge of the weft reaches in a weft insertion process including an end time of the weft insertion, and is one of a plurality of arrival positions where a timing at which the leading edge of the weft reaches the arrival position can be determined from the passage timing in the free flight process, and the set position arrival timing at which the leading edge of the weft reaches the set arrival position, determining the passage timing based on a detection signal output from the weft detection sensor in the weft insertion during weaving, determining an actual value of the set position arrival timing from the passage timing, comparing the determined actual value with the reference value, and in a case where a deviation occurs between the determined actual value and the reference value determining a correction amount of the set value based on the deviation so as to change a driving mode of the weft insertion related device so that the deviation decreases.

In the weft insertion device according to the present invention for realizing the weft insertion method, in addition to the weft detection sensor, the weft insertion control device includes a passage timing detector that determines a passage timing which is the passage timing based on a detection signal output from the weft detection sensor, a reference value storage that stores a reference value of a set position arrival timing in association with a set arrival position, regarding the set arrival position, which is an arrival position at which a leading edge of the weft reaches in a weft insertion process including an end time of weft insertion, and where a timing at which the leading edge of the weft reaches the arrival position is one of a plurality of arrival positions that can be determined from the passage timing in the free flight process, and the set position arrival timing at which the leading edge of the weft reaches the set arrival position, an actual value determiner that determines an actual value of the set position arrival timing, based on the passage timing determined by the passage timing detector, a comparator that compares the actual value with the reference value, and a set value corrector that determines a correction amount of the set value based on a deviation so as to change a driving mode of the weft insertion related device so that the deviation decreases in a case where the deviation occurs between both values.

However, as apparent from the description that the "weft insertion related device" in the present invention is described as "driven in accordance with the set value stored in a set value storage", the weft insertion related device is a device whose drive is performed electrically. The weft insertion related device is a device that affects the timing at which the weft starts to fly or the state where the weft flies as described above, and includes the above-described locking pin and clamping mechanism driven by an electric actuator such as a solenoid. In a case where a weft insertion pump that supplies pressurized water to a weft insertion nozzle is electrically driven, the weft insertion pump is also included.

In the weft insertion method and the weft insertion device according to the present invention, one of the arrival positions reached by the leading edge of the weft at each of passage times of the weft passing between the storage drum and the weft detection sensor a plurality of times in the free flight process may be set as the set arrival position.

In a case where the weft insertion related device is the locking pin and the clamping mechanism, a correction amount of the set value may be determined for at least one of the locking pin and the clamping mechanism in the weft insertion method. Similarly, the set value corrector may be configured to determine the correction amount of the set value for at least one of the locking pin and the clamping mechanism in the weft insertion device.

According to the present invention, in the water jet loom provided with the weft insertion device including the measuring and storing device of the type as described above, the correction amount of the set value is determined based on the deviation so as to change a driving mode for the weft insertion related device so that the deviation decreases in a case where the deviation occurs between both values as a result of comparing the actual value and the reference value during weaving. When the set value is corrected based on the correction amount, the weft insertion related device is driven according to the corrected set value. As a result, weaving is performed in a state where the arrival timing is as constant as possible, because the change is eliminated even when a change in the arrival timing occurs with the progress of the weaving.

Therefore, even in a case where a change in the arrival timing that causes a slack of weft occurs, the weaving is performed in a state where the change is eliminated. Therefore, the weaving is not continued in a state where the slack of weft can occur. As a result, it is possible to prevent the quality of the woven fabric from being deteriorated due to the change in the arrival timing.

DETAILED DESCRIPTION OF THE INVENTION

Figure 1:
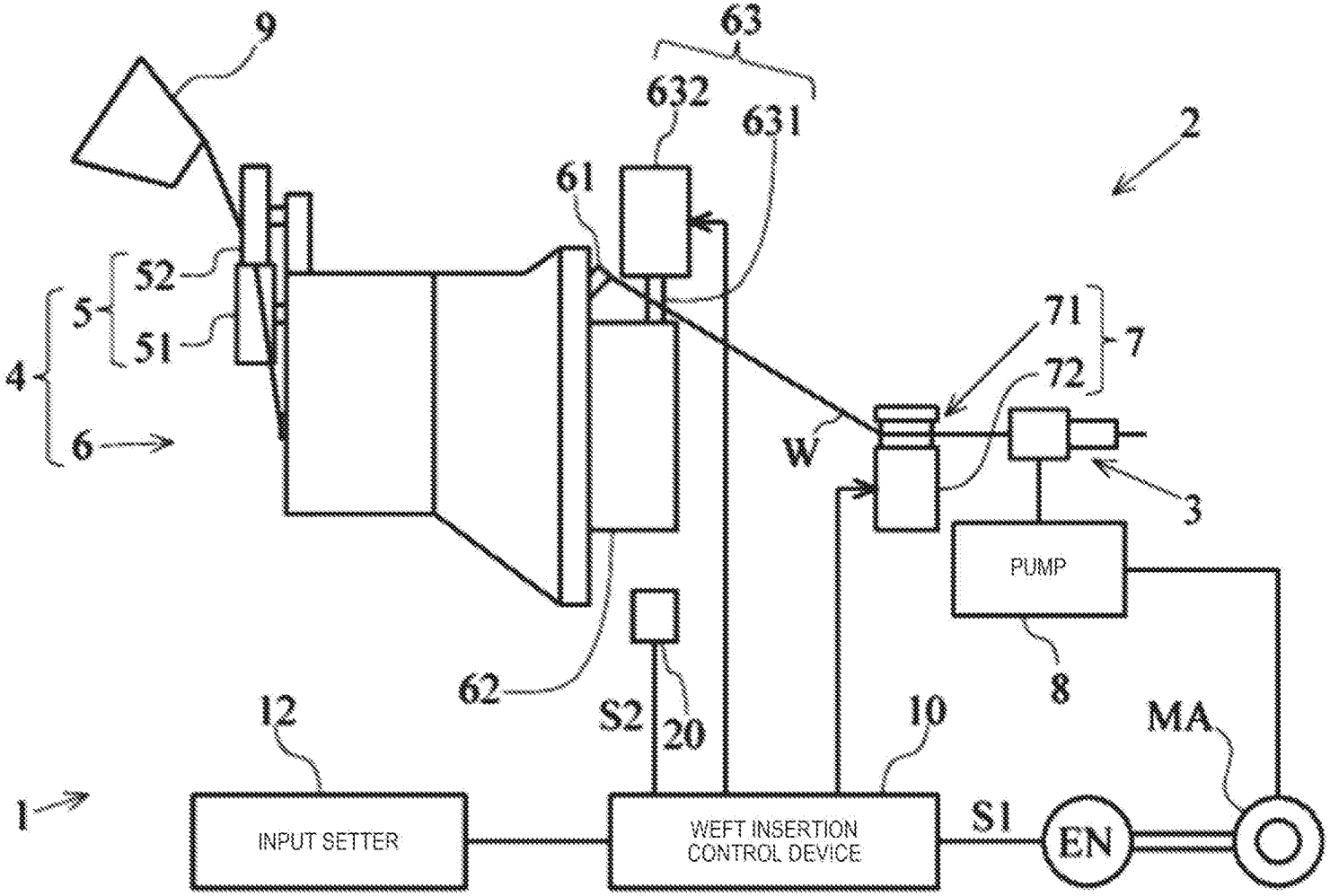
FIG. 1 is a schematic diagram illustrating an example of a prerequisite device of the present invention.
Figure 2:
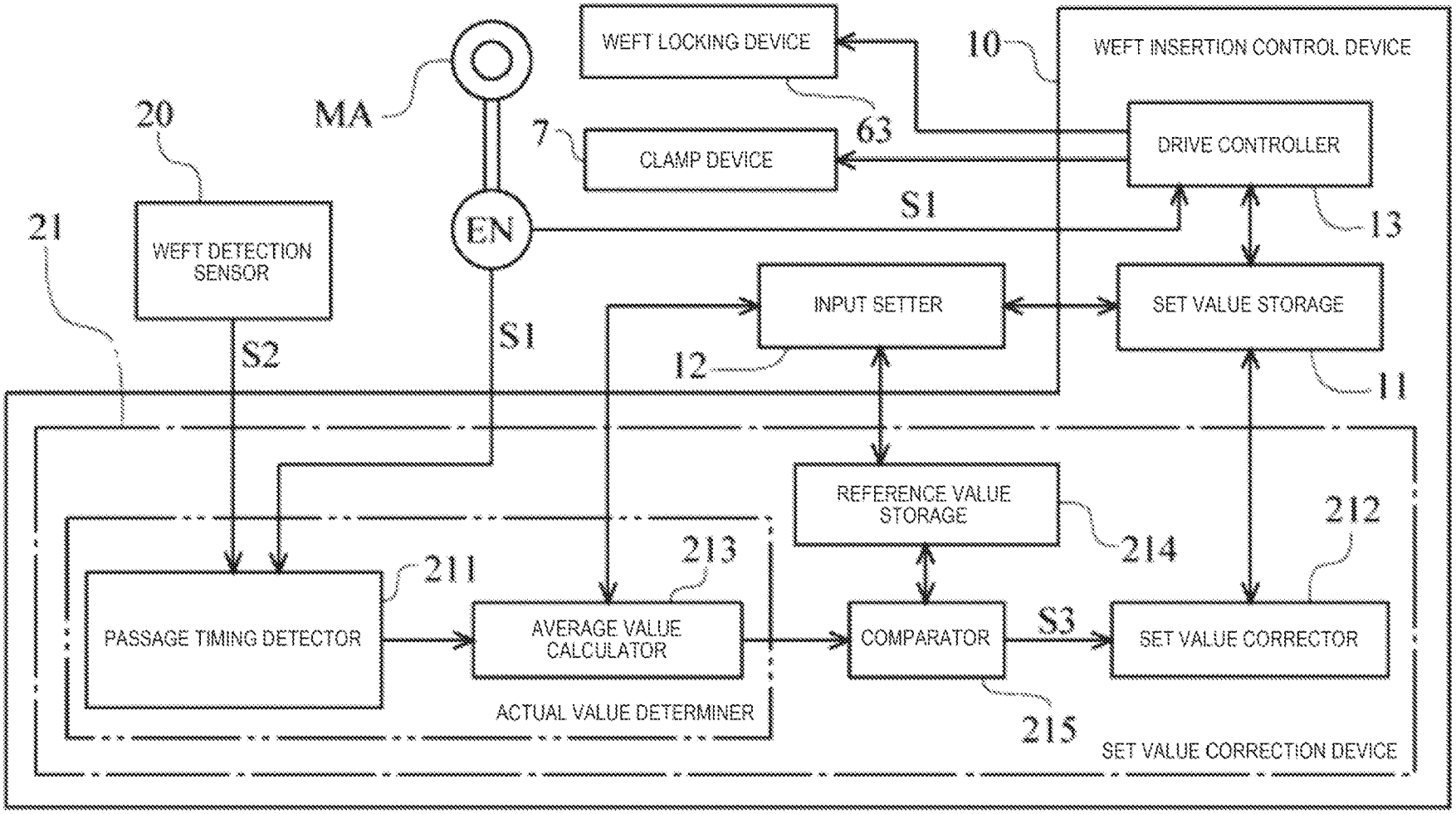
FIG. 2 is a block diagram illustrating an example of a weft insertion control device.

An embodiment of a weft insertion method and a weft insertion device in a water jet loom according to the present invention will be described below with reference to FIGS. 1 and 2.

First, as a premise, a weft insertion device 2 in a water jet loom 1 is provided with a weft insertion nozzle 3, a measuring and storing device 4, and a clamp device 7. The weft insertion nozzle 3 is connected to a pump 8 for supplying pressurized water for weft insertion to the weft insertion nozzle 3. However, the water jet loom 1 of the present embodiment is configured such that the pump 8 is mechanically driven using a main shaft MA of a loom 1 as a drive source, and is configured to supply the pressurized water to the weft insertion nozzle 3 at a certain timing in one cycle of the loom 1. Therefore, a timing at which the injection of the pressurized water from the weft insertion nozzle 3 is started in each weaving cycle (hereinafter, referred to as "injection start timing") is constant.

The measuring and storing device 4 includes a storage device 6 including a rotary yarn guide 61 and a storage drum 62 on which a weft W is wound and stored by rotation of the rotary yarn guide 61 and a measuring device 5 including a measuring roller 51 for feeding the weft W from a yarn feeder 9 toward the rotary yarn guide 61. Details are as follows.

First, the measuring device 5 includes the measuring roller 51 as described above, and is configured such that the measuring roller 51 is mechanically connected to the main shaft MA, and is rotationally driven using the main shaft MA as a drive source. The measuring device 5 includes a driven roller 52 provided in a pressed state with the measuring roller 51. Then, in the measuring device 5, the weft W drawn out from the yarn feeder 9 is passed between the measuring roller 51 and the driven roller 52 in a pressed state. As a result, the measuring roller 51 is rotationally driven as described above, so that the measuring device 5 feeds the weft W toward the storage device 6 in cooperation with the measuring roller 51 and the driven roller 52. However, the rotation speed of the rotationally driven measuring roller 51 is set such that the weft W of a length (weft insertion length) required for one weft insertion is fed in a period corresponding to one cycle of loom 1 (period during which the main shaft MA rotates once) in relation to an outer diameter of the measuring roller 51.

The storage device 6 includes the rotary yarn guide 61 as described above, and is configured such that the rotary yarn guide 61 is mechanically connected to the main shaft MA and is continuously driven to rotate using the main shaft MA as a drive source. The storage device 6 includes the storage drum 62 on which the weft W is wound by the rotary yarn guide 61. Then, the rotation speed of the rotary yarn guide 61 rotationally driven as described above is a speed based on the outer diameter (winding diameter) of the storage drum 62 and the rotation speed of the measuring device 5.

Furthermore, the storage device 6 includes a weft locking device 63 including a locking pin 631 for locking the weft W on the storage drum 62, and a pin drive 632 for driving the locking pin 631 forward and rearward. However, the pin drive 632 includes a drive unit such as a solenoid and is configured to electrically drive the locking pin 631. In the storage device 6, when the locking pin 631 in weft locking device 63 is in an advanced state and the weft W is locked, the weft W is wound on the storage drum 62 with the rotation of the rotary yarn guide 61 as described above, and when the locking pin 631 is driven rearward and separated from the storage drum 62, the weft W wound on the storage drum 62 can be released.

The clamp device 7 is provided between the weft insertion nozzle 3 and the measuring and storing device 4. The clamp device 7 includes a clamping mechanism 71 including a pair of disk-shaped grip members for gripping the weft W, and a clamp drive 72 that drives the clamping mechanism 71. However, the clamp drive 72 includes a drive unit such as a solenoid, and is configured to electrically drive the clamping mechanism 71. The clamp drive 72 drives the grip member of the clamping mechanism 71 so as to switch between a gripped state where the weft W is gripped and a released state where the grip is released.

Furthermore, the weft insertion device 2 is provided with a weft insertion control device 10 that controls the driving of the locking pin 631 in the weft locking device 63 and the clamping mechanism 71 (grip member) in the clamp device 7 that are electrically driven as described above.

The weft insertion control device 10 includes a set value storage 11, and the set value storage 11 stores each set values of a timing for driving the locking pin 631 and a timing for driving the clamping mechanism 71. Specifically, the set values of the timing for driving the locking pin 631 are a set value of a timing for driving the locking pin 631 to advance (advance timing) and a set value of a timing for driving the locking pin 631 to retract (retreat timing). The set values of the timing for driving the clamping mechanism 71 are a set value of a timing for switching the clamping mechanism 71 from the released state to the gripped state (gripping timing), and a set value of a timing for switching the clamping mechanism 71 from the gripped state to the released state (release timing).

However, in the present embodiment, it is assumed that the retreat timing of the locking pin 631 is set as a timing later than the release timing of the clamping mechanism 71 so that flying of the weft W starts with the retreat of the locking pin 631 as described later. Therefore, the retreat timing of the locking pin 631 is a timing at which the weft W starts to fly (weft insertion start timing), and the release timing of the clamping mechanism 71 is set before the weft insertion start timing. Incidentally, the advance timing of the locking pin 631 is set before a time when a leading edge of the flying weft W reaches a predetermined position on a receiving side (weft insertion end timing), and the gripping timing of the clamping mechanism 71 is set after the weft insertion end timing.

The water jet loom 1 is provided with an input setter 12, and the weft insertion control device 10 is electrically connected to the input setter 12. The each set value is input and set by the input setter 12, transmitted from the input setter 12 to the set value storage 11 of the weft insertion control device 10, and stored in the set value storage 11. Incidentally, the input setter 12 is provided with a display screen (not shown), and the display screen includes a so-called touch panel. Then, the input setter 12 is configured to perform the input setting of each set value by touching the display screen.

Furthermore, the weft insertion control device 10 includes a drive controller 13 that controls operations of the pin drive 632 driving the locking pin 631 of the weft locking device 63 and the clamp drive 72 driving the clamping mechanism 71 (grip member) of the clamp device 7. The drive controller 13 is electrically connected to the set value storage 11, and controls the operations of the pin drive 632 and the clamp drive 72 in accordance with each set value stored in the set value storage 11 described above so that the locking pin 631 and the grip member are driven at each timing according to each set value. Therefore, the drive controller 13 is also electrically connected to an encoder EN provided in the water jet loom 1 for detecting a rotational angle of the main shaft MA, and an angle signal S corresponding to the rotational angle of the main shaft MA detected by the encoder EN is input.

In the weft insertion device 2 as described above, regarding the weft insertion, first, the injection of the pressurized water from the weft insertion nozzle 3 is started at the above-described injection start timing. Next, the clamping mechanism 71 of the clamp device 7 is driven to release at the release timing, and the locking pin 631 is driven rearward at the subsequent retreat timing. In this manner, the pressurized water is ejected from the weft insertion nozzle 3 and the locking pin 631 is driven rearward in a state where the grip by the clamp device 7 (clamping mechanism 71) is released, so that the flying of the weft W starts at the time when the locking pin 631 is retreated (retreat timing).

At the time when the flying of the weft W starts in this manner, a weft W having a length corresponding to the amount of rotation of the rotary yarn guide 61 from the time when the previous weft insertion is ended to the time when the flying of the weft W starts (start time) is stored on the storage drum 62. Therefore, the weft W on the storage drum 62 flies for a while from the start time in a so-called free flight state where the weft W is released and pulled out from the storage drum 62. However, the winding of the weft W around the storage drum 62 by the rotary yarn guide 61 is continued even in a process in which the weft W flies in such a state of free flight (free flight process). However, in the free flight process, a release speed of the weft W from the storage drum 62 is faster than a winding speed by the rotary yarn guide 61, so that the weft W on the storage drum 62 gradually decreases.

When all the wefts W on the storage drum 62 are released, the wefts W are thereafter drawn directly from the rotary yarn guide 61 without passing through the storage drum 62. In that state, the weft W flies in a so-called constrained flight state where a flight speed is constrained by a feed speed of the measuring roller 51 (measuring device 5). That is, in the premise of the present invention in which the measuring and storing device 4 of the weft insertion device 2 is configured as described above, one weft insertion is started in an aspect of the weft W flying in a free flight state, the free flight process ends before the weft insertion end timing, and subsequently is performed in an aspect that there is a process in which the weft W flies in a constrained flight state as described above (constrained flight process).

When the locking pin 631 is driven to advance at the advance timing, the weft W flying in the constrained flight state is locked to the locking pin 631 on the storage drum 62, and the flight is stopped. As a result, the weft insertion device 2 is in a state where one weft insertion is ended. In the weft insertion process, the time at which the weft W is locked by the locking pin 631 in this manner is a time at which the leading edge of the weft W reaches the predetermined position on the receiving side as described above, and is a time when the weft insertion end timing matches (end time of weft insertion).

As described above, in the weft insertion device 2 of the water jet loom 1 of the present embodiment, the locking pin 631 and the clamping mechanism 71 are driven according to the set value of the timing stored in the set value storage 11. As described above, after the clamping mechanism 71 is released and driven so that the grip of the weft W is released, the weft W starts flying as the locking pin 631 is driven rearward in this state. That is, the operation of the locking pin 631 affects the timing at which the weft W starts to fly. Therefore, in the present embodiment, the locking pin 631 corresponds to a "weft insertion related device" referred to in the present invention.

In the water jet loom 1 provided with the weft insertion device 2 as described above, in the present invention, in order to make the arrival timing of the weft W as constant as possible, the weft insertion device 2 is provided with a weft detection sensor 20 that detects the passage in order to determine a passage timing which is a passage timing of the weft W circulating around the storage drum 62 in accordance with the weft insertion. Then, the weft insertion device 2 is configured to control the driving of the weft insertion related device based on the passage timing (release timing at which the weft W is released from the storage drum 62) in the free flight process. However, in the present embodiment, the weft insertion related device is the locking pin 631 as described above, and the retreat timing, which is the weft insertion start timing, is controlled. Details are as follows.

First, in the present invention, the weft insertion device 2 is provided with the weft detection sensor 20 for determining the passage timing as described above. The weft detection sensor 20 is provided so as to face the storage drum 62 in a radial direction of the storage drum 62. In the present embodiment, the weft detection sensor 20 is provided in a circumferential direction of the storage drum 62 so as to be located in the vicinity of the weft locking device 63 (however, in FIG. 1, for convenience, the storage drum 62 is illustrated as being provided at a position opposite to the weft locking device 63 with the storage drum 62 interposed therebetween). Then, the weft detection sensor 20 is configured to detect the passage of the weft W and output a detection signal S2 of the weft W as the weft W passes between the weft detection sensor 20 and the storage drum 62. The weft detection sensor 20 is electrically connected to the weft insertion control device 10. The detection signal S2 is output to the weft insertion control device 10.

In the present embodiment, it is assumed that the weft W for five windings is released from the storage drum 62 in a free flight process in one weft insertion. Therefore, in the free flight process, the weft detection sensor 20 detects the passage five times and outputs the detection signal S2 five times to the weft insertion control device 10.

The weft insertion control device 10 includes a set value correction device 21 that corrects the set value of the weft insertion related device (in the present embodiment, set value of the retreat timing of the locking pin 631) based on the passage timing determined from the detection signal S2 output from the weft detection sensor 20, in addition to the set value storage 11 and the drive controller 13 as described above. Therefore, the set value correction device 21 includes a passage timing detector 211 for determining the passage timing and a set value corrector 212 for correcting the set value of the retreat timing. The passage timing detector 211 is electrically connected to the weft detection sensor 20 and the encoder EN, and is configured to determine the passage timing (release timing) from the detection signal S2 output from the weft detection sensor 20 and the angle signal S1 output from the encoder EN.

However, in the present embodiment, the correction of the set value of the retreat timing is performed based on the passage timing (release timing) determined from a fifth detection signal S2 in the free flight process. Therefore, the passage timing detector 211 is configured to determine the release timing only for the detection signal S2 input for the fifth timing among the detection signals S2 output from the weft detection sensor 20 in each weaving cycle as described above and output the release timing.

In the present embodiment, the correction of the set value of the retreat timing is performed based on an average value of the release timing determined by the passage timing detector 211 as described above, and an average value in the weft insertions for 30 times. Therefore, the set value correction device 21 includes an average value calculator 213 electrically connected to the passage timing detector 211.

The average value calculator 213 is configured to sequentially store the release timings output from the passage timing detector 211, and calculate the average value of the release timing when the number of the stored release timings reaches the weft insertions for 30 times. The average value calculator 213 is electrically connected to the input setter 12. The average value calculator 213 is configured to store the set value of the number of weft insertions that is input and set by the input setter 12 and transmitted from the input setter 12, for the set value of the number of weft insertions as a basis of the calculation (weft insertions for 30 times). The average value calculator 213 is configured to output the average value determined by the calculation and reset the release timing stored in accordance with the output.

Then, the set value correction device 21 is configured to correct the set value of the retreat timing, based on a deviation between the average value of the release timing determined by the set value corrector 212 based on the detection as described above and a preset reference value of the release timing of the fifth time. Therefore, the set value correction device 21 includes a reference value storage 214 for storing the reference value, and a comparator 215 for comparing the average value and the reference value in order to determine the deviation. The reference value storage 214 is electrically connected to the comparator 215 for the comparison in the comparator 215, and is also electrically connected to the input setter 12. The reference value is input and set by the input setter 12, transmitted from the input setter 12 to the reference value storage 214, and stored in the reference value storage 214 as described above.

The comparator 215 is electrically connected to an output terminal of the average value calculator 213, and is also electrically connected to an input terminal of the set value corrector 212. Therefore, the average value determined as described above and output from the average value calculator 213 is input to the comparator 215. Then, the comparator 215 is configured to perform the comparison in response to the input of the average value, and output a deviation signal S3 corresponding to the deviation to the set value corrector 212 in a case where the deviation occurs as a result of the comparison. The comparator 215 is configured not to generate the deviation signal S3 (not to output to the set value corrector 212) in a case where the deviation does not occur as a result of the comparison.

The set value corrector 212 is configured to correct the set value of the retreat timing as described above in accordance with the input of the deviation signal S3 from the comparator 215. Therefore, the set value corrector 212 is configured to determine a correction amount of the set value of the retreat timing based on the deviation signal S3 (deviation). Furthermore, the set value corrector 212 is configured to read out the set value of the retreat timing stored in the set value storage 11 in accordance with the determination of the correction amount in this manner, correct the set value of the retreat timing based on the determined correction amount (specifically, correction amount is added to the set value of the retreat timing (absolute value is subtracted in a case where the correction amount is a negative value)), and output the set value of the retreat timing after the correction to the set value storage 11. Then, the set value storage 11 is configured to update the stored set value of the retreat timing as the set value of the retreat timing after the correction is input.

A method of determining the correction amount by the set value corrector 212 (configuration for determining the correction amount) may be, for example, a method (configuration) of storing a database set in an aspect in which the deviation is associated with the correction amount in the set value corrector 212 in advance, and selecting the correction amount corresponding to the deviation from the database based on the deviation signal S3 from the comparator 215. A method (configuration) may be a method (configuration) of causing the set value corrector 212 to preset an arithmetic expression for calculating the correction amount based on the deviation, and calculating the correction amount corresponding to the deviation based on the deviation signal S3 from the comparator 215 using the arithmetic expression.

According to the weft insertion device 2 of the present embodiment as described above, as the weft W is released from the storage drum 62 in each weft insertion, the weft W circulates around the storage drum 62 and passes between the storage drum 62 and the weft detection sensor 20. As described above, in the free flight process in the weft insertion process, the weft W for five windings of the storage drum 62 is released from the storage drum 62. In other words, in the weft insertion process, when the weft W for five windings of the storage drum 62 is released from the storage drum 62, the free flight process is shifted to the constrained flight process. In the constrained flight process, the weft W is in a state of circulating around the storage drum 62 in a state of being directly drawn out from the rotary yarn guide 61 toward the weft insertion nozzle 3.

As described above, each time the weft W passes between the storage drum 62 and the weft detection sensor 20, the weft detection sensor 20 detects the passage and outputs a detection signal S2 to the passage timing detector 211. The passage timing detector 211 is configured to count the number of inputs and determines the rotational angle of the main shaft MA at that time from the angle signal S1 from the encoder EN when the count value reaches 5, that is, when the fifth detection signal S2 is input. The determined rotational angle of the main shaft MA is the release timing described above, and the passage timing detector 211 outputs the determined release timing to the average value calculator 213. In the passage timing detector 211, the count value is reset when the release timing is output.

When the release timing is output from the passage timing detector 211 for each weft insertion as described above, the average value calculator 213 sequentially stores the input release timing. The average value calculator 213 is configured to count the number of times of the input, and calculates an average value of the release timing (release timing of weft insertions for 30 times) when a count value reaches 30, that is, when the number of the stored release timings reaches the weft insertions for 30 times. The average value calculator 213 outputs the calculated average value to the comparator 215. In the average value calculator 213, the release timings and the count values of the weft insertions for 30 times stored as described above are reset when the average value is output.

When the average value is output from the average value calculator 213, the comparator 215 compares the input average value with the reference value stored in the reference value storage 214. The comparator 215 outputs a deviation signal S3 corresponding to the deviation to the set value corrector 212 in a case where the deviation is occurred as a result of the comparison. However, in a case where the deviation is zero as a result of the comparison, the comparator 215 does not generate the deviation signal S3 as described above (does not output to the set value corrector 212).

Based on the fact that the average value is determined from the release timing, the state where the deviation occurs is due to the fact that the release timing (passage timing) is changed from the reference value in the weft insertion for which the average value is determined. As described above, since the change in the release timing affects the arrival timing, in that state, the arrival timing also changes with respect to a target timing which is the arrival timing in a state where the weft insertion is normally performed.

Therefore, control (wen insertion control) for eliminating the state where the deviation occurs is performed. Specifically, when the deviation signal S3 is output from the comparator 215 as described above, the set value corrector 212 determines a correction amount of the set value of the retreat timing based on the input deviation signal S3 (deviation) by the determining method described above. Accordingly, the set value corrector 212 corrects the set value of the retreat timing stored in the set value storage 11 based on the determined correction amount. After the correction, the locking pin 631 is driven rearward in accordance with the corrected set value of the retreat timing.

As a result, the weft insertion start timing is changed to a timing at which the deviation can be eliminated. As a result, the deviation in the release timing is eliminated, that is, the release timing (passage timing) substantially coincides with the reference value. Accordingly, the change of the arrival timing with respect to the target timing as described above is eliminated, and thereafter (until the next change as described above occurs), the weft insertion is performed in a state where the arrival timing substantially coincides with the target timing. Thereafter, even when a change in the release timing (arrival timing) occurs again as described above, the weft insertion control is performed each time and the change is eliminated, so that the weft insertion is performed as constant as possible as a whole.

In the present embodiment, the weft insertion control is performed based on the fifth release timing, which is the passage timing at the last release of the weft W from the storage drum 62 of a plurality of times in the free flight process. As a result, the change in the arrival timing is more appropriately eliminated. Specifically, the fifth release timing is a time at the end of the free flight process, and a time when the constrained flight process starts immediately thereafter. Since a flight speed of the weft W in the constrained flight process is constrained by the feed speed of the measuring roller 51 and is constant, the deviation determined based on the fifth release timing can be regarded as a deviation of the arrival timing from the target timing as it is. Therefore, the change in the arrival timing is eliminated by controlling the weft insertion so as to eliminate the determined deviation, so that the change in the arrival timing is more appropriately eliminated.

In the embodiment described above, in the free flight process of weft insertion as described above, the weft insertion is performed while the weft W wound on the storage drum 62 is released from the storage drum 62. Therefore, a distance from the weft insertion nozzle 3 at an arrival position where the leading edge of the weft W reaches (hereinafter, "arrival position reached by the leading edge of the weft W" is simply referred to as "arrival position") substantially coincides with a release length from the storage drum 62 in the free flight process. Since the arrival position in the weft insertion process is generally represented by the distance from the weft insertion nozzle 3, the arrival position in the free flight process corresponds to the release length. Incidentally, the length of the weft for one winding in the storage drum 62 is substantially the same from the first winding to the final winding (fifth winding in the present embodiment) released in the free flight process. Therefore, the arrival position in the free flight process is determined by the number of release×length of the weft for one winding. Since the length of the weft for one winding is a known value determined in advance and is a fixed value, the arrival position can be replaced by the number of winding of the weft W released from the storage drum 62 (number of release).

Then, in the present embodiment, the deviation is determined from a reference value for the fifth release timing (fifth passage timing and a timing when the fifth weft W is released from the storage drum 62) and a value determined from the detection. In other words, the deviation is set based on the fact that the fifth release timing is determined (weft W for five windings is released). As is apparent from the above, the fact that the weft W for five windings is released coincides with the fact that the leading edge of the weft W is reached a distance corresponding to the length of the weft for five windings.

Therefore, in the above description of the present embodiment, there is no description about the arrival position, and the setting of five windings (fifth passage timing) of the storage drum 62 in the present embodiment corresponds to a "set arrival position" referred to in the present invention. That is, the release of the weft W for five windings corresponds to "leading edge of the weft reaches the set arrival position" referred to in the present invention. As a result, the fifth passage timing (release timing) corresponds to a "set position arrival timing" referred to in the present invention.

In the present embodiment, an average value of the weft insertions for 30 times is determined based on the fifth passage timing (release timing) determined during weaving, and the average value is compared with the reference value. Therefore, in the present embodiment, the average value determined in this manner corresponds to the "actual value" referred to in the present invention. Furthermore, in the present embodiment, the average value as an actual value is calculated by the average value calculator 213 based on the fifth passage timing (release timing) determined by the passage timing detector 211. That is, the average value is determined by the passage timing detector 211 and the average value calculator 213. Therefore, in the present embodiment, the combination of the passage timing detector 211 and the average value calculator 213 corresponds to an "actual value determiner" referred to in the present invention.

The present invention is not limited to the embodiments described above, and can be performed in embodiments modified as in the following (1) to (4).

(1) In the above embodiment, in the free flight process, in the weft insertion device 2 in which the weft W for five windings is released from the storage drum 62 (weft W passes between the storage drum 62 and the weft detection sensor 20 five times) in the free flight process, five windings of the storage drum 62 (arrival position when the fifth weft W passage is detected) are set as the set arrival positions referred to in the present invention. Then, in the above embodiment, the weft insertion device 2 is set so that the passage timing (release timing) referred to in the present invention is determined at the time when the fifth (last) passage is detected. That is, in the above embodiment, the last arrival position of the arrival positions (final arrival position in the free flight process) at each of passage times of the weft W passing through the storage drum 62 and the weft detection sensor 20 a plurality of times is set as the set arrival position in the free flight process.

However, in the present invention, even in a case where the set arrival position is one of a plurality of arrival positions in the free flight process in this manner, the set arrival position is not limited to the final arrival position in the free flight process as in the above embodiment, and may be an arrival position at the passage timing and an intermediate arrival position in the free flight process (hereinafter, simply referred to as "intermediate arrival position"). That is, for example, in the case where the weft W for five windings is released from the storage drum 62 in the free flight process as in the above embodiment, the set arrival position may be set to four windings or lower of the storage drum 62 (arrival position at the time when the passage of the fourth or lower weft W is detected).

However, in a case where the intermediate arrival position is set as the set arrival position as described above, in order to eliminate the change in the arrival timing, the correction amount of the set value of the weft insertion related device is determined based on the deviation between the actual value and the reference value and the number of releases corresponding to the intermediate arrival position.

Specifically, the deviation regarding the timing when the leading edge of the weft W reaches the final arrival position in the free flight process can be considered to substantially coincide with the deviation of the arrival timing from the target timing as described above. On the other hand, in a case where it is considered that the flight speed of the weft W in the free flight process does not substantially change, the deviation at the intermediate arrival position where the leading edge of the weft W reaches (at yarn feeding side) before the final arrival position in the free flight process appears as a small deviation as compared with the deviation at the final arrival position in the free flight process of the same weft insertion. In that case, as in the above embodiment, when the correction amount of the set value of the weft insertion related device is determined based on the deviation at the intermediate arrival position so that the deviation is eliminated, the change in the arrival timing is not eliminated only by the difference between the deviation at the intermediate arrival position and the deviation at the final arrival position in the free flight process.

Therefore, in a case where the intermediate arrival position is set as the set arrival position, the passage timing and the deviation with respect to the final arrival position may be determined by calculation or the like using the actual value of the passage timing with respect to the intermediate arrival position. Specifically, for example, the flight speed of the weft W in the free flight process in the weft insertion is determined from the intermediate arrival position and the actual value of the passage timing with respect to the intermediate arrival position. The passage timing (calculated value) with respect to the final arrival position is calculated by calculation based on the determined flight speed. Then, using the calculated value of the passage timing with respect to the determined final arrival position, the comparison with the reference value and the weft insertion control may be performed as in the above embodiment.

(2) In the above, an example is described in which one of a plurality of arrival positions (intermediate arrival position and final arrival position) in the free flight process is set as the set arrival position. However, the present invention is not limited to setting the arrival position directly corresponding to the passage timing in the free flight process (directly determined from the passage timing) to the set arrival position. The arrival position determined by calculation or the like from the passage timing in the free flight process may be set as the set arrival position.

Therefore, for example, the above-described predetermined arrival position on the receiving side (arrival position at the end time of weft insertion) may be set as the set arrival position. However, in this case, the actual value and the reference value to be compared are values for the arrival timing with respect to the predetermined arrival position on the receiving side. Then, in each weft insertion, a calculated value of the arrival timing with respect to a predetermined arrival position on the receiving side is determined. For example, a method of determining the calculated value may be performed as follows.

First, the final arrival position in the free flight process can be gripped in advance as described above. Therefore, the distance from the final arrival position to the above-described predetermined arrival position (set arrival position) on the receiving side can be determined in advance. Then, since the flight speed of the weft W in the constrained flight process coincides with the feed speed of the measuring roller 51 (measuring device 5) and can be gripped in advance, the time from the start of the constrained flight to the arrival of the leading edge of the weft W at the set arrival position can be determined in advance by the rotational angle of the main shaft MA based on the distance, the flight speed, and the number of rotations of the loom 1.

Therefore, the time is determined in advance, and the determined time (rotational angle of the main shaft MA) is added to the passage timing with respect to the final arrival position in the free flight process, so that the calculated value of the arrival timing with respect to the predetermined arrival position on receiving side can be determined. A configuration for determining the calculated value of the arrival timing is, for example, in the passage timing detector 211 in the above embodiment, such that the passage timing with respect to the final arrival position is determined based on the detection signal S2 from the weft detection sensor 20 as in the above embodiment, and the calculated time and the arithmetic expression for adding the calculated time to the passage timing with respect to the determined final arrival position are stored. Then, the passage timing detector 211 may be configured to calculate the calculated value of the arrival timing by the passage timing with respect to the final arrival position determined in each weft insertion, the stored time, and an arithmetic expression.

(3) Regarding the actual value of the set position arrival timing to be compared with the reference value, in the above embodiment, the passage timing at the time when the fifth weft W is released (fifth release timing) is set as the set position arrival timing, and the average value of the passage timings (set position arrival timings) for a plurality of weft insertions (30 times) is set as the actual value. Then, the above embodiment is an example in which the actual value (average value of the set position arrival timing) is determined every time the weft insertion for the number of times to determine the average value is ended.

However, in the present invention, even in a case where the average value of the set position arrival timings in a plurality of weft insertions is set to the actual value as in the above embodiment, the cycle for determining the actual value may be every weft insertion a smaller number of times than the number of weft insertions for determining the average value. That is, the average value of the set position arrival timing in m times of weft insertion may be determined every n times of weft insertion ($n<m$), and the determined average value may be compared with the reference value as the actual value. In such a case, regarding the configuration for determining the average value, for example, the average value calculator 213 in the above embodiment may store the cycle for determining the average value (n times of weft insertion), and the average value calculator 213 may be configured to calculate the average value using the set position arrival timing in the preceding m times of weft insertion for in each cycle.

In the present invention, the actual value is not limited to the average value of the set position arrival timing as described above, and may be the set position arrival timing itself determined in one weft insertion. In that case, the set position arrival timing for each weft insertion may be set as the actual value, or the set position arrival timing for the weft insertion for each predetermined number of weft insertions may be set as the actual value. In the latter case, a cycle (number of weft insertions) for outputting the set position arrival timing to be determined as an actual value may be stored in the passage timing detector 211, and the passage timing detector 211 may be configured to output the set position arrival timing (actual value) for each cycle. In any case, the average value calculator 213 in the configuration of the above embodiment is omitted, and the actual value is directly output from the passage timing detector 211 to the comparator 215. The passage timing detector 211 corresponds to the "actual value determiner" referred to in the present invention.

(4) Regarding the weft insertion related device of the present invention, the above embodiment is an example in which the locking pin 631 corresponds to the weft insertion related device. However, in the present invention, the weft insertion related device is not limited to the locking pin 631 as described above.

For example, in a case where the clamp device 7 is configured so that the clamping mechanism 71 is electrically driven as in the above embodiment, the clamping mechanism 71 may correspond to the weft insertion related device referred to in the present invention. Specifically, in the above embodiment, the case where the locking pin 631 is driven rearward after the clamping mechanism 71 is driven to be released, that is, the case where the weft insertion is started with the rearward driving of the locking pin 631 is described in the present invention. However, the driving order of the clamping mechanism 71 and the locking pin 631 in a general loom is not limited to the case of the above embodiment, and the clamping mechanism 71 may be released after the locking pin 631 is driven rearward. In that case, the weft insertion is started with the release drive of the clamping mechanism 71. Therefore, in that case, the clamping mechanism 71 corresponds to a weft insertion related device that affects the timing at which the weft W starts to fly.

Therefore, in the case where the clamping mechanism 71 corresponds to the weft insertion related device, the release drive of the clamping mechanism 71 is controlled based on the deviation between the actual value and the reference value for the set position arrival timing, similarly to the retreat drive of the locking pin 631 in the above embodiment. That is, in that case, the set value of the release timing of the clamping mechanism 71 is corrected based on the deviation.

In the case where the clamping mechanism 71 is released after the locking pin 631 is driven rearward as described above, when the release timing is corrected as described above, the correction changes a degree of slack of weft W between the storage drum 62 and the clamping mechanism 71, and the change may affect the flight state of the weft W (arrival timing). Specifically, in the case where the clamping mechanism 71 is released after the locking pin 631 is driven rearward as described above, the weft W between the storage drum 62 and the clamping mechanism 71 is slackened during a period from the time when the locking pin 631 is driven rearward to the time when the clamping mechanism 71 is released. Then, when the period changes due to the correction of the release timing, the degree of slack changes with the change. The release resistance of the weft W from the storage drum 62 in the early stage of the free flight process changes due to the change in the degree of slack, and the flight speed (flight state) of the weft W may change accordingly.

Therefore, in the case where the change in the degree of slack affects the flight state of the weft W (arrival timing), regarding the correction of the release timing based on the deviation, it is preferable that the correction amount is determined based on not only the deviation but also a change in the flight speed accompanying a change in the degree of slack due to the correction.

The change in the degree of slack occurs as described above because only the release timing of the clamping mechanism 71 as the weft insertion related device is changed and the set value of the retreat timing of the locking pin 631 is constant. On the other hand, as described above, the release timing of the clamping mechanism 71 as the weft insertion related device is corrected according to the deviation. Accordingly, when the weft insertion device 2 is configured so that the retreat timing of the locking pin 631 is also corrected by the same amount, the degree of slack does not change. Therefore, in the case of the configuration, the correction amount of the set value of the release timing (=correction amount of the set value of the retreat timing) may be made to correspond to the deviation as in the above embodiment. In this case, since the correction of the retreat timing of the locking pin 631 is performed in consideration of a change in the flight speed (flight state) of the weft W, the locking pin 631 also corresponds to the weft insertion related device.

Regarding the weft insertion related device, the case where at least one of the locking pin 631 and the clamping mechanism 71 corresponds to the weft insertion related device referred to in the present invention is described above, and the present invention is not limited thereto. Any other device that is electrically driven and that affects the timing at which the weft W starts to fly or the state where the weft W flies may be used.

For example, a pump that supplies pressurized water for weft insertion to the weft insertion nozzle 3 is one example. Specifically, in the above embodiment, the pump 8 is described as being mechanically driven by using the main shaft MA of the loom as a drive source. The pump used in the water jet loom 1 is not limited to such a mechanically driven pump, and a pump electrically driven by a motor as a drive source is also known.

The known pump that is electrically driven as described above include a pump that can change a pressure of a discharged pressurized water by changing a state where a biasing force of a spring acts on a plunger as a result of a suction process, or a pump that can change a timing at which a discharge process by a plunger is started by a biasing force of a spring. In the former case, the flight speed (flight state) of the weft W is changed by changing the pressure of the pressurized water ejected from the weft insertion nozzle. In the latter case, the timing at which the injection of pressurized water is started from the weft insertion nozzle 3 is changed. Therefore, for example, in a case where the retreat timing of the locking pin 631 or the release timing of the clamping mechanism 71 is constant, the flight state of the weft W changes by changing the degree of influence of the pressurized water on the weft W. Furthermore, in the latter case, the timing at which the injection of the pressurized water is started may be changed in consideration of the retreat timing or the release timing, so that it is also possible to change the timing at which the weft W starts to fly.

Therefore, in a case where the pump that is electrically driven as described above is employed in the water jet loom 1, the pump may be the weft insertion related device in the present invention, and the state where the biasing force of the spring acts on the plunger or the timing at which the discharge process is started may be corrected based on the deviation.

The present invention is not limited to the embodiment described above, and can be variously modified without departing from the gist of the present invention.

What is claimed is:

1. A weft insertion method using a weft insertion device in a water jet loom that includes a measuring and storing device including a storage device having a rotary yarn guide continuously driven to rotate and a storage drum on which a weft is wound and stored by a rotation of the rotary yarn guide, and a measuring device having a measuring roller which continuously feeds the weft from a yarn feeder toward the rotary yarn guide at a predetermined feed speed corresponding to a weft insertion length, and a weft insertion related device which is involved in a weft insertion and affects a timing at which the weft starts to fly or a state where the weft flies, and is driven according to a set value stored in a set value storage of a weft insertion control device, and wherein the weft insertion device includes the weft insertion control device for controlling drive of the weft insertion related device, in which one weft insertion is performed through a constrained flight process in which the weft flies while being constrained by a feed speed of the measuring roller by being in a state where the weft is drawn directly from the rotary yarn guide without passing through the storage drum, after a free flight process in which the weft flies in a free flight state by being drawn while the weft on the storage drum is released from the storage drum, in which the weft insertion device includes a weft detection sensor provided so as to face the storage drum and detecting passages of the weft to determine passage timings which are timings at which the weft circulating around the storage drum with the weft insertion passes between the weft detection sensor and the storage drum, the weft insertion method comprising:

determining a set arrival position, which is an arrival position at which a leading edge of the weft reaches in a weft insertion process including an end time of the weft insertion, and is one of a plurality of arrival positions where a timing at which the leading edge of the weft reaches the arrival position can be determined from the passage timings in the free flight process;

setting in advance a reference value of a set position arrival timing at which the leading edge of the weft reaches the set arrival position, in association with the set arrival position; and determining the passage timings based on a detection signal output from the weft detection sensor in the weft insertion during weaving, determining an actual value of the set position arrival timing from the passage timings, comparing the determined actual value with the reference value, and in a case where a deviation occurs between the determined actual value and the reference value, determining a correction amount of the set value based on the deviation so as to change a driving mode of the weft insertion related device so that the deviation decreases.

2. The weft insertion method using the weft insertion device in the water jet loom according to claim 1, wherein one of the arrival positions reached by the leading edge of the weft at each of the passage timings of the weft passing between the storage drum and the weft detection sensor a plurality of times in the free flight process is set as the set arrival position.

3. The weft insertion method using the weft insertion device in the water jet loom according to claim 1, wherein the weft insertion related device includes a locking pin driven to lock and release the weft on the storage drum, and a clamping mechanism driven to grip the weft between a weft insertion nozzle and the measuring and storing device and release the grip during the weft insertion, and the correction amount of the set value is determined for at least one of the locking pin and the clamping mechanism.

4. The weft insertion method using the weft insertion device in the water jet loom according to claim 2, wherein the weft insertion related device includes a locking pin driven to lock and release the weft on the storage drum, and a clamping mechanism driven to grip the weft between a weft insertion nozzle and the measuring and storing device and release the grip during the weft insertion, and the correction amount of the set value is determined for at least one of the locking pin and the clamping mechanism.

5. A weft insertion device in a water jet loom that includes a measuring and storing device including a storage device having a rotary yarn guide continuously driven to rotate and a storage drum on which a weft is wound and stored by a rotation of the rotary yarn guide, and a measuring device having a measuring roller which continuously feeds the weft from a yarn feeder toward the rotary yarn guide at a predetermined feed speed corresponding to a weft insertion length, and a weft insertion related device which is involved in a weft insertion and affects a timing at which the weft starts to fly or a state where the weft flies, and is driven according to a set value stored in a set value storage of a weft insertion control device, and wherein the weft insertion device includes the weft insertion control device for controlling drive of the weft insertion related device, in which one weft insertion is performed through a constrained flight process in which the weft flies while being constrained by a feed speed of the measuring roller by being in a state where the weft is drawn directly from the rotary yarn guide without passing through the storage drum, after a free flight process in which the weft flies in a free flight state by being drawn while the weft on the storage drum is released from the storage drum, the weft insertion device comprising:

a weft detection sensor provided so as to face the storage drum, and detecting passages of the weft circulating around the storage drum with the weft insertion, wherein the weft insertion control device includes a passage timing detector that determines passage timings, wherein the passage timings are based on a detection signal output from the weft detection sensor, a reference value storage that stores a reference value of a set position arrival timing at which a leading edge of the weft reaches a set arrival position, in association with the set arrival position, wherein the set arrival position is an arrival position at which the leading edge of the weft reaches in a weft insertion process that includes an end time of the weft insertion, and the set arrival position is one of a plurality of arrival positions where a timing at which the leading edge of the weft reaches the arrival position can be determined from the passage timings in the free flight process, an actual value determiner that determines an actual value of the set position arrival timing, based on the passage timings determined by the passage timing detector, where the actual value determiner includes the passage timing detector, a comparator that compares the actual value with the reference value, and a set value corrector that determines, in a case where a deviation occurs between the actual value and the reference value, a correction amount of the set value based on the deviation so as to change a driving mode of the weft insertion related device so that the deviation decreases.

6. The weft insertion device in the water jet loom according to claim 5, wherein one of the arrival positions reached by the leading edge of the weft at each of the passage times of the weft passing between the storage drum and the weft detection sensor a plurality of times in the free flight process is set as the set arrival position.

7. The weft insertion device in the water jet loom according to claim 5, wherein the weft insertion related device includes a locking pin driven to lock and release the weft on the storage drum, and a clamping mechanism driven to grip the weft between a weft insertion nozzle and the measuring and storing device and release the grip during the weft insertion, and the set value corrector determines the correction amount of the set value for at least one of the locking pin and the clamping mechanism.

8. The weft insertion device in the water jet loom according to claim 6, wherein the weft insertion related device includes a locking pin driven to lock and release the weft on the storage drum, and a clamping mechanism driven to grip the weft between a weft insertion nozzle and the measuring and storing device and release the grip during the weft insertion, and the set value corrector determines the correction amount of the set value for at least one of the locking pin and the clamping mechanism.

* * * * *